US005169335A

United States Patent [19]

Sayre

[11] Patent Number: 5,169,335

[45] Date of Patent: Dec. 8, 1992

[54] THRU-BOARD RELEASED CONNECTOR

[75] Inventor: James L. Sayre, 1418 Vinci Pkwy., San Jose, Calif. 95131

[73] Assignee: James L. Sayre, San Jose, Calif.

[21] Appl. No.: 654,861

[22] Filed: Feb. 13, 1991

[51] Int. Cl.[5] ..... H01R 13/627

[52] U.S. Cl. ..... 439/364; 439/79

[58] Field of Search ..... 439/361, 362, 364, 365, 439/65, 79, 559, 564, 573, 680, 681

[56] References Cited

U.S. PATENT DOCUMENTS

| | | | |
|---|---|---|---|
| 1,738,711 | 12/1929 | Jones | 439/573 |
| 3,173,734 | 3/1965 | Hartwell | 439/364 |
| 3,208,026 | 9/1965 | Ruehlemann | 439/79 |
| 3,404,362 | 10/1968 | Amendola | 439/79 |
| 3,476,983 | 11/1969 | De Robertis . | |
| 3,989,333 | 11/1976 | Cauldwell . | |
| 4,012,094 | 3/1977 | VanRenssen et al. . | |
| 4,131,933 | 12/1978 | Agard et al. | 439/359 |
| 4,175,820 | 11/1979 | Wilmes et al. . | |
| 4,318,157 | 3/1982 | Ranle et al. | 439/362 |
| 4,324,448 | 4/1982 | Palloch et al. . | |
| 4,361,371 | 11/1982 | Williams . | |
| 4,364,618 | 12/1982 | Godsey . | |
| 4,533,203 | 8/1985 | Feldman et al. | 439/65 |
| 4,627,759 | 12/1986 | Kato et al. | 439/680 |
| 4,703,394 | 10/1987 | Petit et al. | 439/65 |
| 4,811,168 | 3/1989 | Chesnut et al. . | |
| 4,874,318 | 10/1989 | Spencer | 439/364 |
| 4,934,941 | 6/1990 | Okada | 439/65 |
| 4,957,449 | 9/1990 | Hatagishi | 439/364 |
| 5,017,146 | 5/1991 | Uehava et al. | 439/65 |

FOREIGN PATENT DOCUMENTS

| | | | |
|---|---|---|---|
| 0241220 | 10/1986 | Japan | 439/573 |
| 0021879 | 1/1989 | Japan | 439/573 |

*Primary Examiner*—Paula A. Bradley
*Assistant Examiner*—Hien D. Vu
*Attorney, Agent, or Firm*—Townsend and Townsend

[57] ABSTRACT

A coupling system connecting a plug of a device or printed wiring board to a receptacle on a motherboard within a chassis. A coupling screw is provided as part of the receptacle which passes through the receptacle and motherboard and extends towards the plug. By providing the coupling screw in the receptacle and an attachment structure in the plug, simple and convenient coupling of the device or printed wiring board to the motherboard is possible. Additionally, size and space restrictions on the device or printed wiring board and chassis near the plug are removed. The device or printed wiring board may be coupled or decoupled from the motherboard by operation of a head of the coupling screw either through a hole in an access plate or chassis wall in the chassis or by extending the coupling screw to the chassis outside surface of the plate or chassis wall. In a second embodiment, it is possible to use the improved coupling system to connect a cable within a chassis to a motherboard without unnecessary service loops or blindmate connectors within the chassis. Again, by providing coupling screws passing through the receptacle towards a plug on the cable and by operating the head of the coupling screw either through holes in the access plate or chassis wall, or by removing the access plate, the cable is simply and conveniently coupled and decoupled from the motherboard.

2 Claims, 7 Drawing Sheets

THRU-BOARD RELEASED CONNECTOR

BACKGROUND OF THE INVENTION

The present invention is directed to a connector apparatus, and specifically relates to an improved connector permitting a simple coupling and uncoupling of a plug of a printed wiring board or electrical cable to a receptacle of a printed-wiring board such as a motherboard.

Conventional printed wiring boards (PWB) often include a plug that forms one-half of a coupling system; the other one-half is the receptacle for receiving the plug. The plug typically carries the male contacts which mate to complementary female contacts of the receptacle to establish electrical communication between the PWB and circuitry carried, for example, by a motherboard.

In order to ensure that the plug/receptacle mating connection is reliably maintained, the plug/receptacle assembly is constructed to be held together by threaded bolt construction of various types (e.g., a bolt and nut or threaded insert). Typically, the construction includes a bolt mounted on the plug with a head structure configured to be engaged by such tools as a screwdriver or hex driver for connecting the plug to, or removing the plug from, the receptacle. Unfortunately, connectors of the type normally used place the head structure facing the interior portion of a chassis in and in close proximity to the PWB, thereby limiting the number, type, and orientation of circuit components that can be located on the PWB adjacent or near the plug. In addition, due to a need to provide clearance space for an operator's hands and screwdriver, the chassis must be less densely packaged. Additional access doors must often be provided to facilitate this access. More versatile and superior PWB and chassis layouts are possible if the space and access restrictions could be reduced or eliminated.

Another similar problem arises when connecting an electrical cable or device to, for example, a motherboard by such plug/receptacle assembly. Inside a chassis, access to the head structure of the threaded bolts can be limited by other parts within the chassis. A solution has been to provide a service loop in the cable to permit removal of the device with attached cable from the chassis. Once outside, the connection or disconnection of the plug and the receptacle can easily occur. Unfortunately, the service loop takes up space within the chassis and is prone to being damaged. Another prior art solution to this problem was to use blind mate or connectors hard-mounted to the chassis. These connectors eliminate the need for service loops but are inconvenient and expensive to use, requiring mounting brackets, alignment pins, and additional chassis machining.

These prior art solutions increase cost, complexity, chassis size, and decrease efficiency in coupling plugs to a motherboard within a chassis.

SUMMARY OF THE INVENTION

The present invention provides a method and apparatus for securing a PWB, device, cable or other plug to a motherboard receptacle, reducing design restrictions near connecting structures securing the plug and the receptacle. The invention offers several advantages over existing methods and apparatus. Some of the advantages include simplified part placement on a PWB connected to a motherboard, removal of service loops in cables, reduction in number and size of chassis access doors, and elimination of chassis-mounted connectors.

One aspect of the invention includes a receptacle on a motherboard configured to mate to a complementary plug connector of a PWB. A coupler passes through an aperture in the motherboard and the receptacle and mates to a complementary attachment structure in the plug. Access to a head of the coupler from the motherboard side, opposite that of the receptacle/plug combination, permits simple coupling and decoupling from outside the chassis. The motherboard side access also decreases size and positioning limitations on the PWB components near the plug and on the associated chassis elements.

A second aspect of the present invention is useful to mate a plug of a cable or device to a motherboard receptacle. Making the receptacle with an attached coupler which interfaces with an attachment structure of the plug of the cable permits simple coupling and decoupling of the cable relative to the motherboard. Operation of the coupler occurs from a direction easy to access, that is, the motherboard side of the connector combination. When the motherboard is within a chassis, holes in a chassis wall or a removable access plate with apertures permit access to the coupler of the receptacle. Alternatively, the head of the couplers extend outside the chassis, permitting operation of the coupler by a coupling tool from without the chassis.

The present invention offers many advantages over coupling systems which are operable from a plug side of a plug/receptacle combination. The novel coupling system expands PWB layout options. An alternate embodiment allows dense packing of parts within an enclosure which includes a cable plug or device mated to a motherboard receptacle.

Reference to the remaining portions of the specification and the drawings permit a further understanding of the nature and advantages of the invention.

DESCRIPTION OF THE PREFERRED EMBODIMENT

Figure 1A:
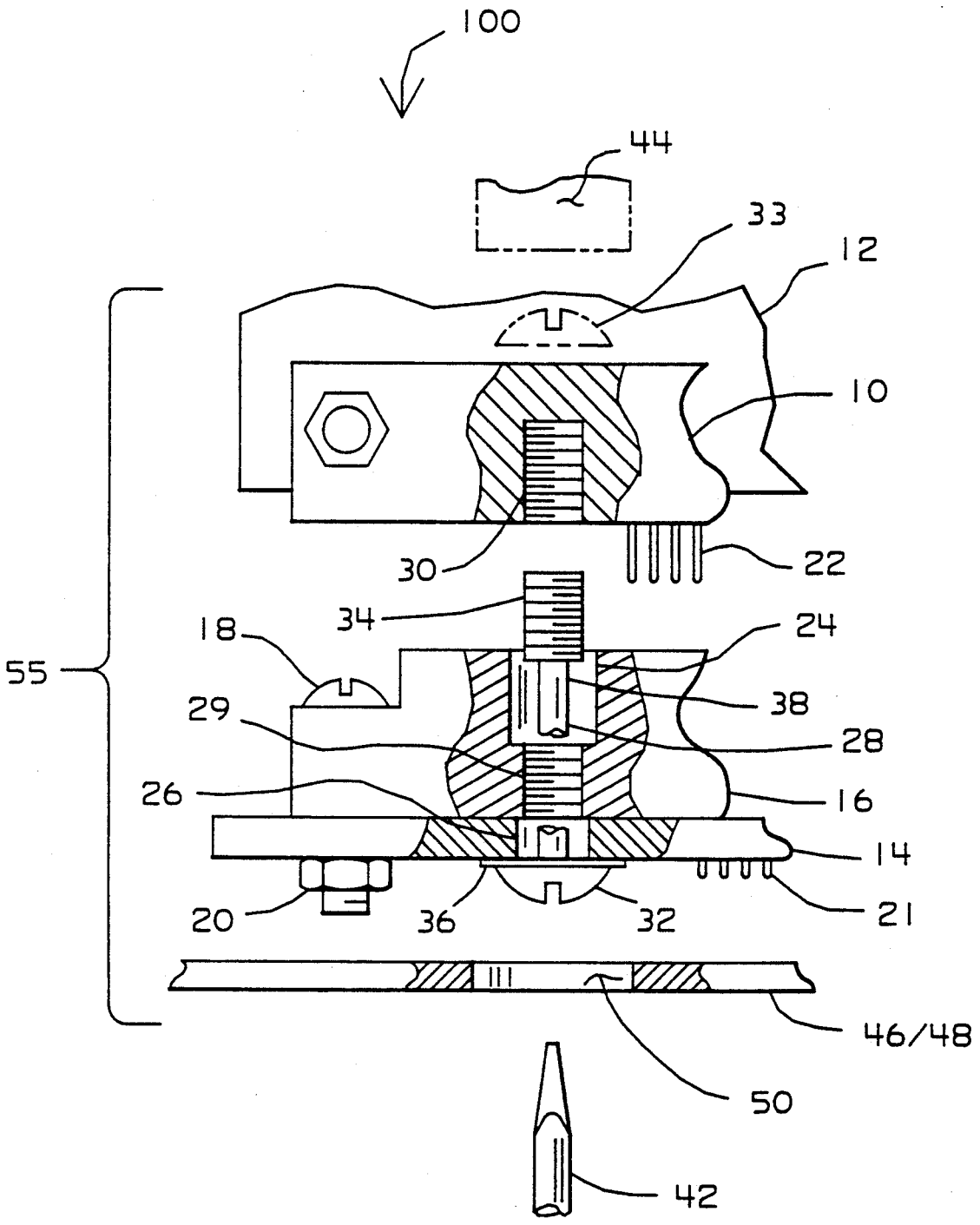
FIG. 1A is an exploded view of a coupling system 100 embodying the present invention.

Turning now to the Figures, FIG. 1A illustrates a connector system 100 embodying the present invention. As shown, the connector system 100 includes a plug 10 for connecting a printed wiring board (PWB) 12 to a motherboard 14 by interfacing with a connector receptacle 16. The receptacle 16 is secured to motherboard 14 by a screw 18, a nut 20, and a plurality of soldered electrical pins 21. The screw 18 can be a jackscrew and also captive in all cases. The plug 10 includes a plurality of male contacts 22 for engagement to complementary female contacts (not shown) located in the receptacle 16. Co-axial apertures 24 and 26 are formed proximate at each end of the receptacle 16 and in the motherboard 14, and through each passes a threaded coupling bolt or screw 28. The receptacle aperture 24 may be threaded 29 to retain the bolt 28 when it is loosened from a threaded plug aperture 30. In some embodiments, conductive traces of the motherboard 14 are routed clear of the aperture 26 to prevent electrical shorting to the screw 28. The coupling screw 28 includes a head 32, a threaded portion 34, flange or washer 36, and a length of reduced diameter 38. (The prior art location of head 32 is shown as a head 33.) An internally threaded aperture 30 in the plug 10 is configured and located to receive the coupling screw 28 when the receptacle 16 and plug 10 are placed in mating, connective engagement.

In use, a coupling tool 42 engages the head 32 and operates the coupling screw 28 to secure the plug 10 and the receptacle 16 together. Securing the plug 10 with the receptacle 16 engages the male contacts 22 and the complementary female contacts, thereby electrically communicating the PWB 12 to the motherboard 14. Access to the coupling screw 28 is from the direction of the motherboard 14 side of the connector system 100. This access direction removes space restrictions imposed in a zone 44 which resulted from part interference with the coupling tool 42 and coupling screw heads 33 configured according to the prior art.

When an access plate 46 or chassis wall 48 covers the motherboard 14, a tool aperture 50 in the access plate 46 or chassis wall 48 permits engagement of the coupling tool 42 with the head 32 from without the chassis. In this fashion, release of the plug 10 from the receptacle 16 releases the PWB 12.

Figure 1B:
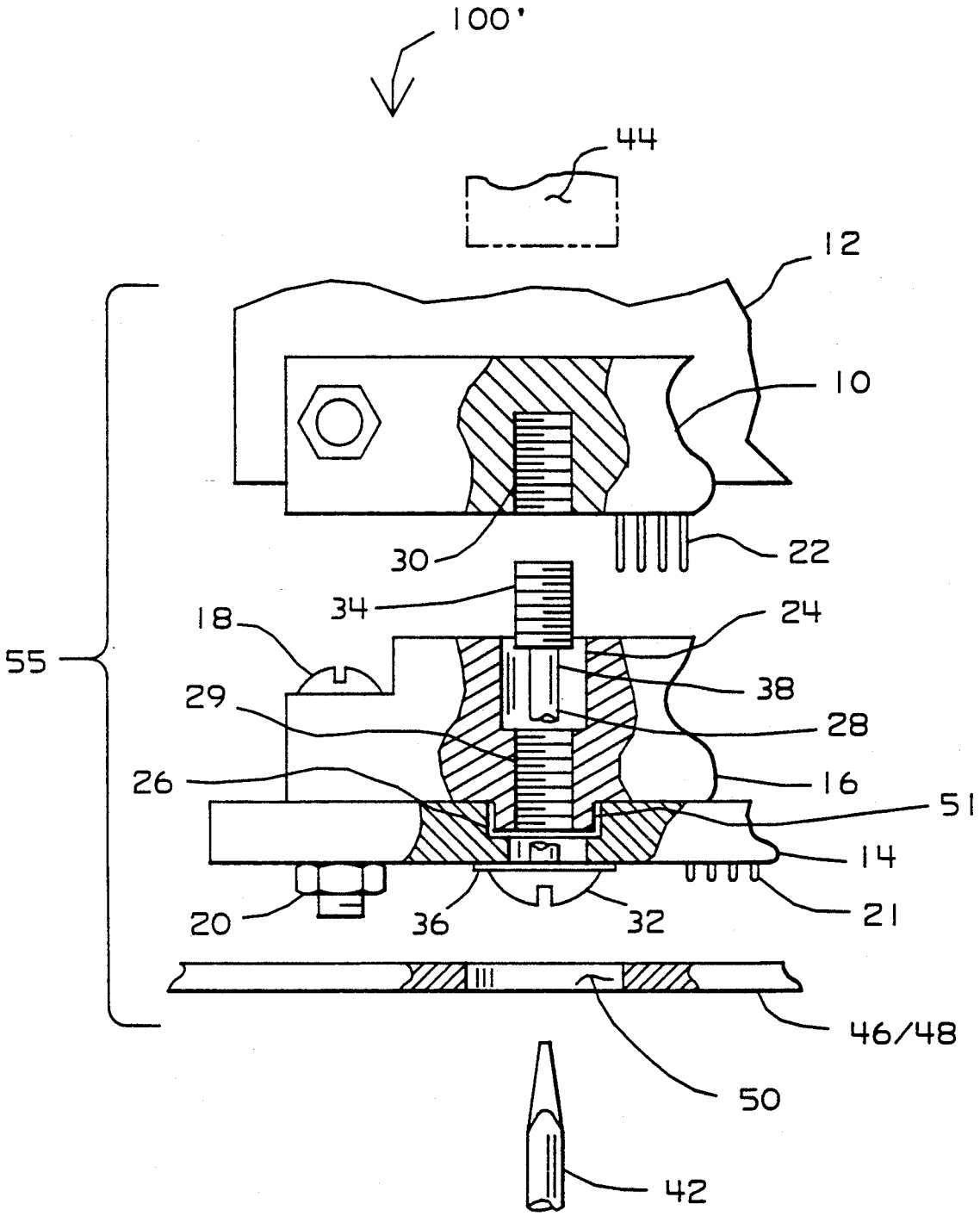
FIG. 1B is an alternate system 100' embodying the present invention.

FIG. 1B illustrates an alternate detail refinement 100' connector system. FIG. 1B differs from FIG. 1A principally by use of a cylindrical insulator 51 that is integral with receptacle 16. These insulators 51 simultaneously position the receptacle 16 on the motherboard 14 and prevent electrical shorts between the motherboard 14 and the bolt 28.

Figure 1C:
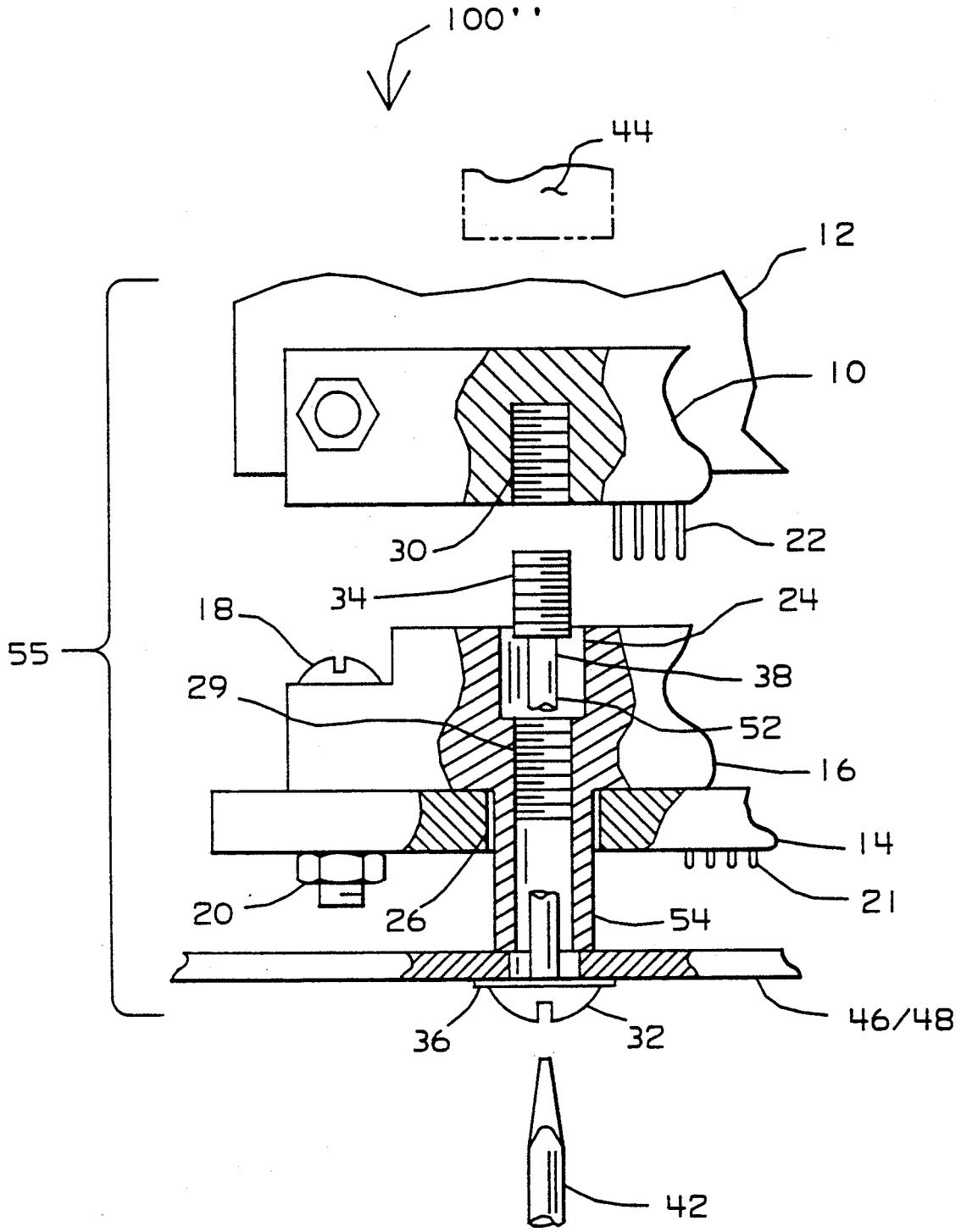
FIG. 1C is an alternate system 100'' embodying the present invention.

FIG. 1C is an alternate connector system 100'' embodying the present invention. The alternate system 100'' extends a longer coupling bolt or screw 52 to the outside of the chassis wall 48 or access plate 46. The alternate system 100'' features a cylindrical insulator 54 between the access plate 46 or chassis wall 48 and the receptacle 16. The insulator 54 provides a means of establishing a fixed distance between the receptacle 16 (and therefore the motherboard 14) and the chassis wall 48 or the plate 46. Therefore, the screw 52, when tightened, mounts the motherboard 14 to the chassis wall 48 or the access plate 46. The head 32 is outside the chassis 55, providing easy access to the long coupling screw 52. As in the embodiment of FIG. 1A, operation of the coupling screw 52 permits coupling and decoupling of the plug 10 relative to the receptacle 16.

Figure 1D:
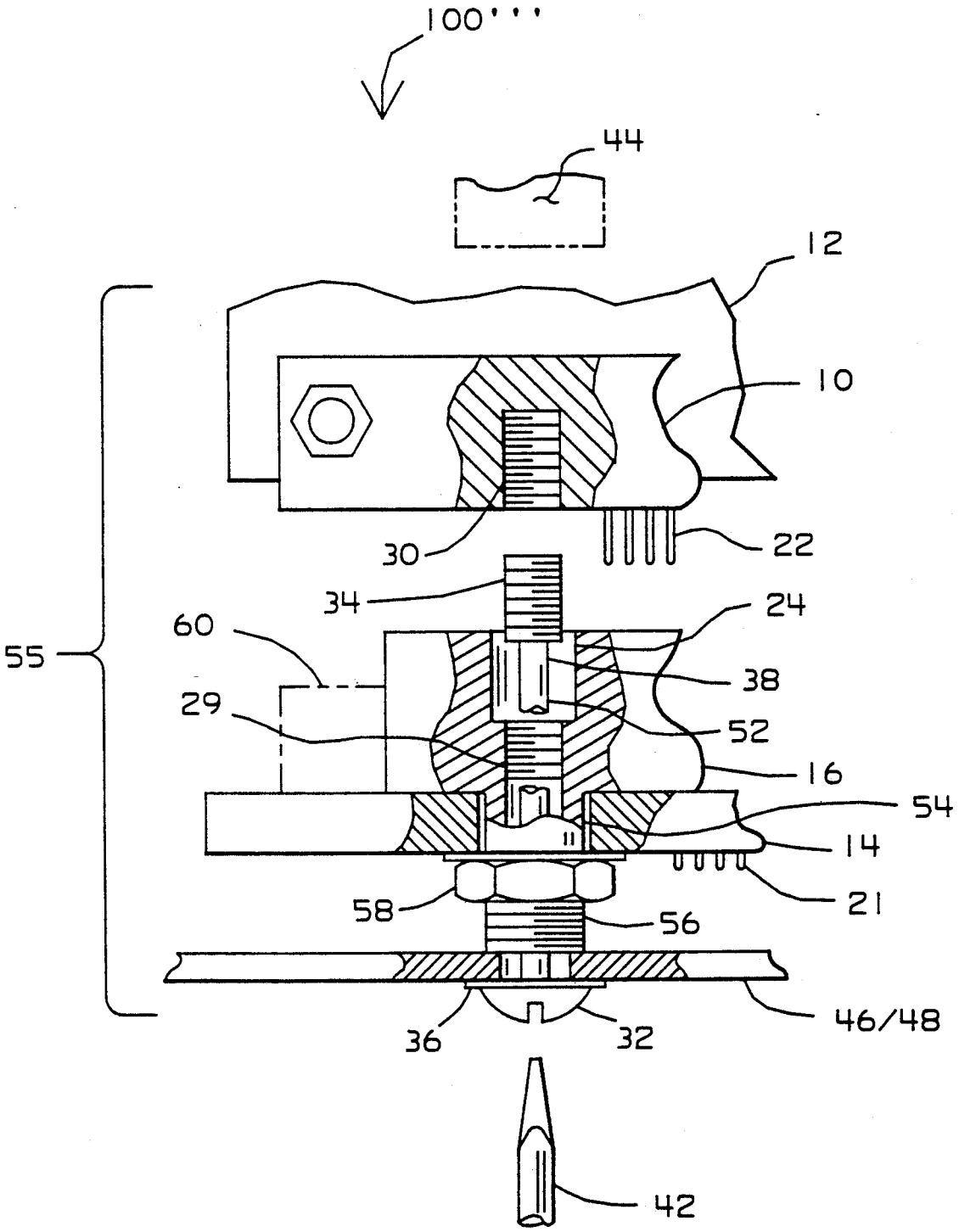
FIG. 1D is an alternate system 100''' embodying the present invention.

FIG. 1D is a variation of connector system 100'' and is identified as system 100'''. A thread 56 on an exterior surface of a cylindrical insulator 54 is mated with a nut 58, thus providing a clamping force between the receptacle 16 and the motherboard 14. As a result, the receptacle 16 can be shorter as there is no need for an excess area 60 to accommodate the screw 18 and the nut 20.

Figure 1E:
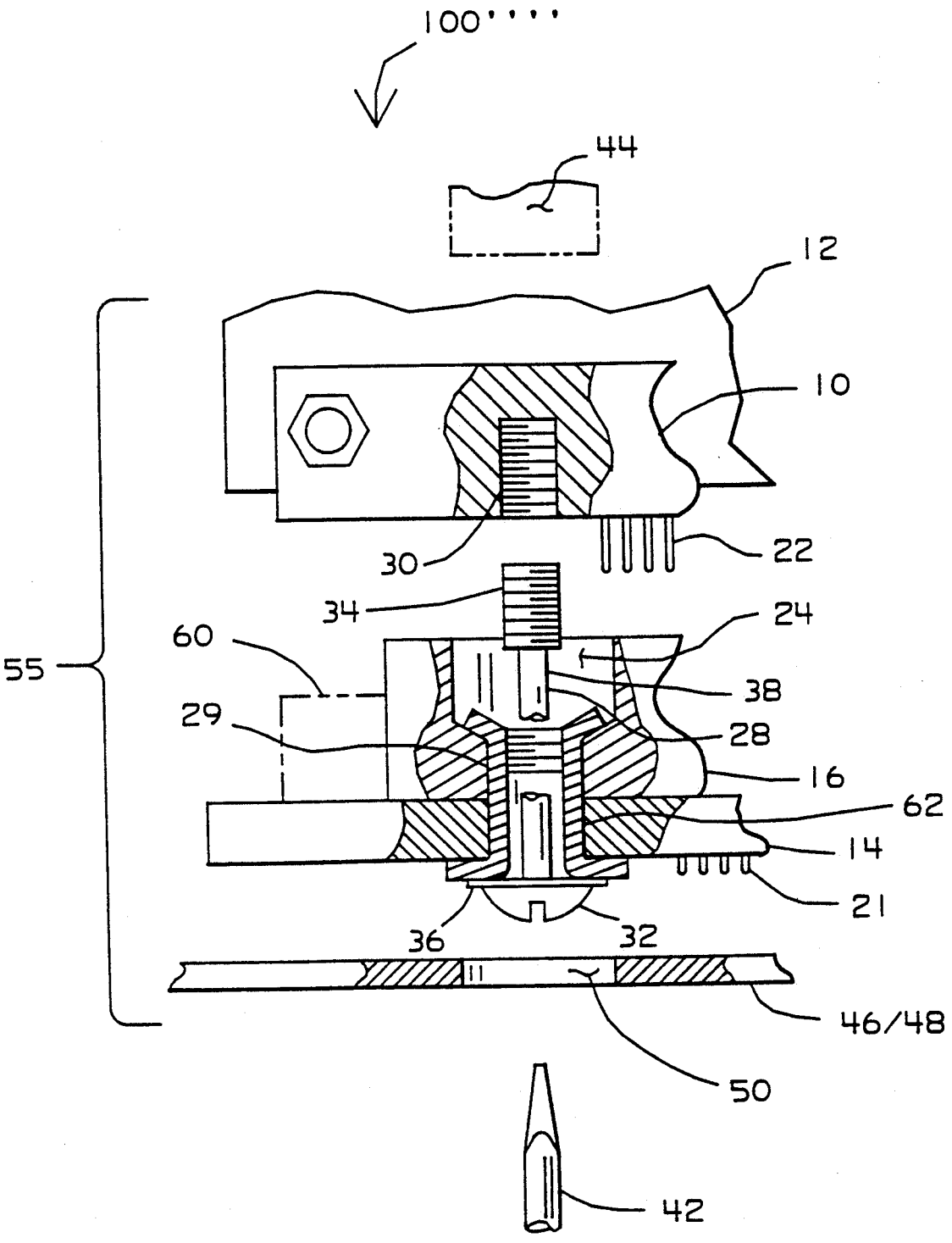
FIG. 1E is an alternate system 100'''' embodying the present invention.

FIG. 1E presents another refinement known as system 100''''. Attachment of the receptacle 16 to the motherboard 14 is accomplished by swagging an end of a retainer tube 62 to an outside surface of the motherboard 14 and to an inside of aperture 24. Interior walls and swaged surfaces of the retainer 62 also protect the motherboard 14 from abrasion by the screw 28. The interior wall of the retainer 62, if threaded properly, will retain the screw 28 when it is loosened from the plug 10. Tool access to the screw head 32 is through the aperture 50.

FIG. 1A through FIG. 1E illustrate use of the present invention to provide easy coupling of a PWB and a motherboard while allowing greater flexibility in PWB part placement and chassis design in a zone 44.

Figure 2A:
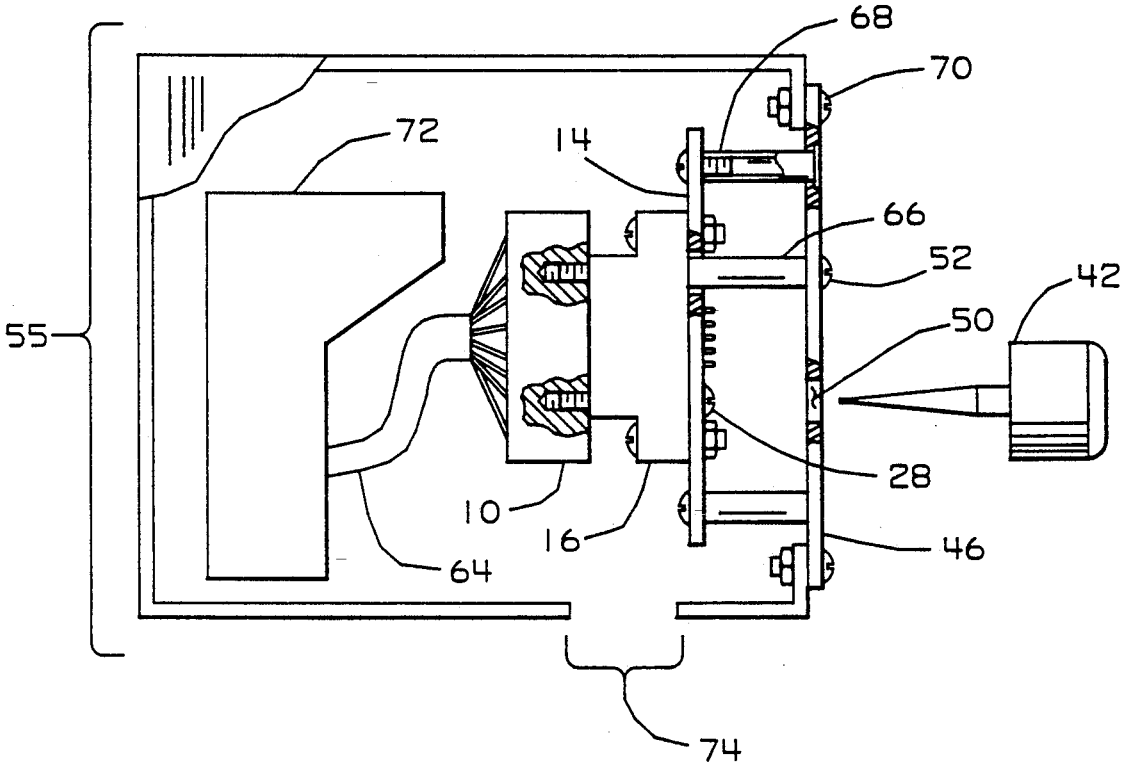
FIG. 2A illustrates use of an embodiment of the present invention to secure the cable 64 to the access plate-mounted motherboard 14 within a chassis 55.

FIG. 2A illustrates use of an embodiment of the present invention to secure a cable 64 to the motherboard 14 within a chassis 55. Operating in a fashion similar to connector systems 100 through 100'''' the cable 64 includes a plug 10 that engages the receptacle 16 attached to the motherboard 14. The receptacle 16 includes a coupling screw 28, or long coupling screw 52, with both configurations illustrated for illustration purposes, while any particular embodiment would use only one particular system. The motherboard 14 is mounted to access plate 46 with integral spacers 66 or threaded spacers 68, both being shown. In turn, access plate 46 is secured to chassis 55 by screws 70. A device 72, such as a power supply, prevents access to coupling screws 28 or 52 from inside the chassis 55. Removal of the motherboard 14 from the chassis 55 is accomplished by decoupling plug 10 from the receptacle 16 with the tool 42 inserted through aperture 50 for the bolt 28, or by engaging the longer screw 52 directly. After decoupling, the screws 70 are removed and the access plate 46, with the attached motherboard 14, is removed from the chassis 55. As the cable 64 and the plug 10 are not required to be moved outside of the chassis 55 for this operation, no service loop is necessary for the cable 64. If a limited lateral access 74 is provided, then no hard-mounting of the plug 10 to the chassis 55 is required.

Figure 2B:
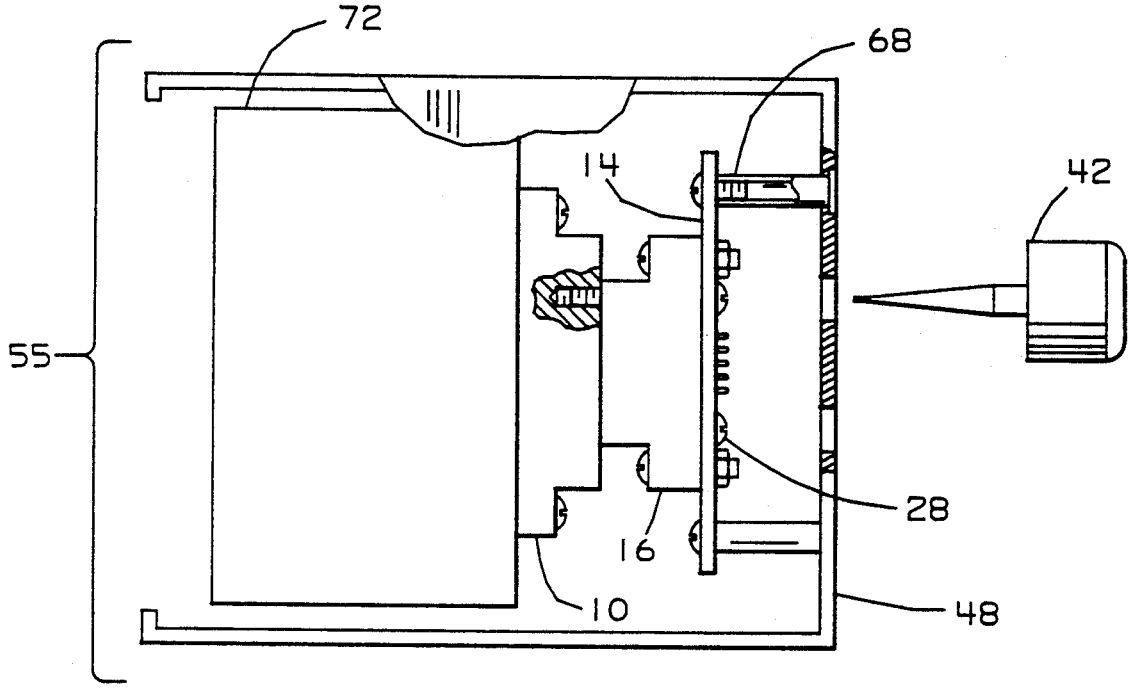
FIG. 2B illustrates use of an alternate embodiment of the present invention to secure the cable 64 or device 72 to the chassis-mounted motherboard 14 within a chassis 46.

FIG. 2B illustrates use of an alternate embodiment of the present invention to connect the motherboard 14 to the device 72 within the chassis 55. The embodiment of FIG. 2B is useful for designs where the motherboard 14 is mounted to the chassis wall 48 by a spacer 68 and situated under the device 72 so that direct access to the plug 10 and the receptacle 16 is denied and a removal of the motherboard 14 is blocked by the device 72.

In a fashion similar to that of FIG. 2A, the screws 28 are rotated by the tool 42 to decouple the plug 10 from the receptacle 16. The device 72 can now be removed from chassis 55, thus enabling subsequent removal of the motherboard 14. Again, no chassis-mounted connector or cable with a service loop is required. Because the plug 10 is affixed to the device 72, no lateral access 74 (FIG. 2A) is needed.

The embodiments illustrated in FIG. 2A and FIG. 2B conveniently and simply couple a cable 64 or device 72 to a motherboard 14. The cable coupling does not require a service loop in the cable 64 or a blindmate or hard-mounted connector. A coupling of the cable 64 or device 72 to the motherboard 14 is possible without removing the motherboard 14 from within the chassis 55, without regard to whether parts, such as the device 72, block access to the plug 10.

In conclusion, the present invention simply and efficiently improves upon conventional connecting systems for coupling a printed wiring board plug, cable plug, or device to a motherboard-mounted receptacle. While this is a complete description of the preferred embodiments of the invention, it is possible to use various alternatives, changes and equivalents. For example, other coupling mechanisms other than jackscrews or coupling screw screws are useable. These coupling mechanisms may not necessarily be screw type fasteners, but other mechanical fasteners operable from a direction different than from conventional screws provided through a plug. Therefore, the above description does not limit the scope of the present invention. The appended claims define the scope of the present invention.

What is claimed is:

1. A coupling system, comprising:

a first mounting plane having a plug mounted on an edge of said first plane, said plug including means for receiving a coupler;

a second mounting plane, orthogonal to said first plane, having a receptacle, said receptacle and said second plane having co-axial apertures, each coaxial aperture having a first diameter;

a coupler, having a flange portion having a second diameter greater than said first diameter, said coupler provided within said coaxial apertures and extending through said receptacle to engage said receiving means of said plug to mate said plug and said receptacle in said orthogonal orientation, said receptacle disposed between said flange portion and said plug; and a cover disposed proximate to said second plane, said cover having an aperture of sufficient diameter to permit means for manipulating said coupler to interact with said coupler through said cover to affect coupling and decoupling of said plug and said receptacle.

2. A coupling system, comprising:

a first mounting plane having a plug mounted on an edge of said first plane, said plug including means for receiving a coupler;

second mounting plane, orthogonal to said first plane, having a receptacle, said receptacle and said second plane having co-axial apertures, each coaxial aperture having a first diameter;

a coupler, having a flange portion having a second diameter greater than said first diameter, said coupler provided within said coaxial apertures and extending through said receptacle to engage said receiving means of said plug to mate said plug and said receptacle in said orthogonal orientation, said receptacle disposed between said flange portion and said plug; and a cover disposed proximate to said second plane, said cover having an aperture with a diameter at least as large as said first diameter and coincident with said first aperture and wherein said coupler extends through said cover and said receptacle are disposed between said plug and said flange portion of said coupler.

* * * * *